US006434830B1

(12) United States Patent
Wu

(10) Patent No.: US 6,434,830 B1
(45) Date of Patent: Aug. 20, 2002

(54) FASTENING STRAP SCISSORS

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 0 days.

(21) Appl. No.: 09/839,420

(22) Filed: Apr. 23, 2001

(51) Int. Cl.[7] ..... B26B 13/06
(52) U.S. Cl. ..... 30/135; 72/325
(58) Field of Search ..... 30/134, 135, 254; 72/325, 332, 464

(56) References Cited

U.S. PATENT DOCUMENTS 300,031 A * 6/1884 Taft ..... 72/464
2,859,445 A * 11/1958 Larrabee ..... 72/325
4,893,493 A * 1/1990 Jacques et al. ..... 72/325

* cited by examiner

*Primary Examiner*—Douglas D. Watts

(57) ABSTRACT

The present invention relates to a pair of fastening strap scissors including two blades pivoted with each other and each having a first end formed with a cutting section and a second secured with a respective handle. The cutting section of each of the two blades is formed with an oblique blade edge and has a distal end formed with a bent hook. The bent hook has a distal end formed with a hook tip located outside of the blade edge. An oblique guide face is formed on the bent hook and located between the blade edge of the cutting section and the hook tip of the bent hook of the cutting section. An insertion angle is formed on the connection of the guide face and the blade edge so as to clip a fastening strap, thereby facilitating the work of cutting the fastening strap.

4 Claims, 6 Drawing Sheets

FASTENING STRAP SCISSORS

BACKGROUND OF THE INVENTION

1. Field of the Invention

The present invention relates to a pair of fastening strap scissors, and more particularly to a pair of fastening strap scissors that can easily cut out the fastening strap encompassing the outer periphery of the dustproof cover.

2. Description of the Related Art

A conventional propeller shaft of an automobile as shown in FIG. 1 includes two shafts 2 and 3. A dustproof cover 1 is mounted on the periphery of the two shafts 2 and 3, and two fastening straps 4 made of metallic material are clamped on the periphery of the dustproof cover 1. If the operator wishes to remove the dustproof cover 1, he has to cut the fastening straps 4 from the dustproof cover 1 previously. Referring to FIG. 2, the operator has to insert a screwdriver 5 having a flat tip into the bottom of the fastening strap 4 to slightly lift the fastening strap 4, so that the side edge of the fastening strap 4 is exposed outward by the screwdriver 5 exerting a pressure on the outer periphery of the dustproof cover 1. Thus, the fastening strap 4 can be cut out by a pair of pliers 6.

However, the blades of the pliers 6 are not easily extended to the bottom of the fastening strap 4 due to the strength of the fastening strap 4, even with assistance of the screwdriver 5, thereby greatly causing inconvenience during the cutting process of the fastening strap 4. In addition, the blades of the pliers 6 are inserted into the bottom of the fastening strap 4 in an oblique manner, so that the blades of the pliers 6 are substantially in parallel with the fastening strap 4. Thus, the fastening strap 4 is not easily cut out by the pliers. Further, the dustproof cover 1 is usually placed in a narrow space, thereby increasing the difficulty of operation.

SUMMARY OF THE INVENTION

The present invention has arisen to mitigate and/or obviate the disadvantage of the conventional tool for cutting the fastening strap.

The primary objective of the present invention is to provide a pair of fastening strap scissors, wherein the bent hooks at the distal ends of the two blades respectively clip and hook the two side edges of the fastening strap, thereby enhancing the convenience of operation.

Another objective of the present invention is to provide a pair of fastening strap scissors, wherein the cutting sections of the blades are bent and extended in the same direction to form a side bent shape, thereby enhancing the convenience of operation in a narrow space.

In accordance with the present invention, there is provided a pair of fastening strap scissors comprising:

two blades pivoted with each other, and each having a first end and a second end, the first end of each of the two blades formed with a cutting section, the cutting section of each of the two blades formed with an oblique blade edge opposite to each other; and two handles each having one end secured to the second end of a respective blade;

wherein, the cutting section of each of the two blades has a distal end formed with a bent hook, the bent hook has a distal end formed with a hook tip located outside of the blade edge, an oblique guide face is formed on the bent hook and located between the blade edge of the cutting section and the hook tip of the bent hook of the cutting section, and an insertion angle is formed on a connection of the guide face and the blade edge to clip a fastening strap, thereby facilitating a work of cutting the fastening strap.

The fastening strap scissors also comprises a push spring mounted between the two handles and having two ends each pivoted with a respective handle, such that the opposite blade edges of the blades are maintained at a normally open state, thereby enhancing a convenience of usage.

In accordance with one embodiment of the present invention, each of the handles has an outer wall extended inward and formed with a hanging hook, and each of the two ends of the push spring is hooked on the hanging hook of a respective handle, thereby positioning the push spring.

Further benefits and advantages of the present invention will become apparent after a careful reading of the detailed description with appropriate reference to the accompanying drawings.

DETAILED DESCRIPTION OF THE INVENTION

Figure 1:
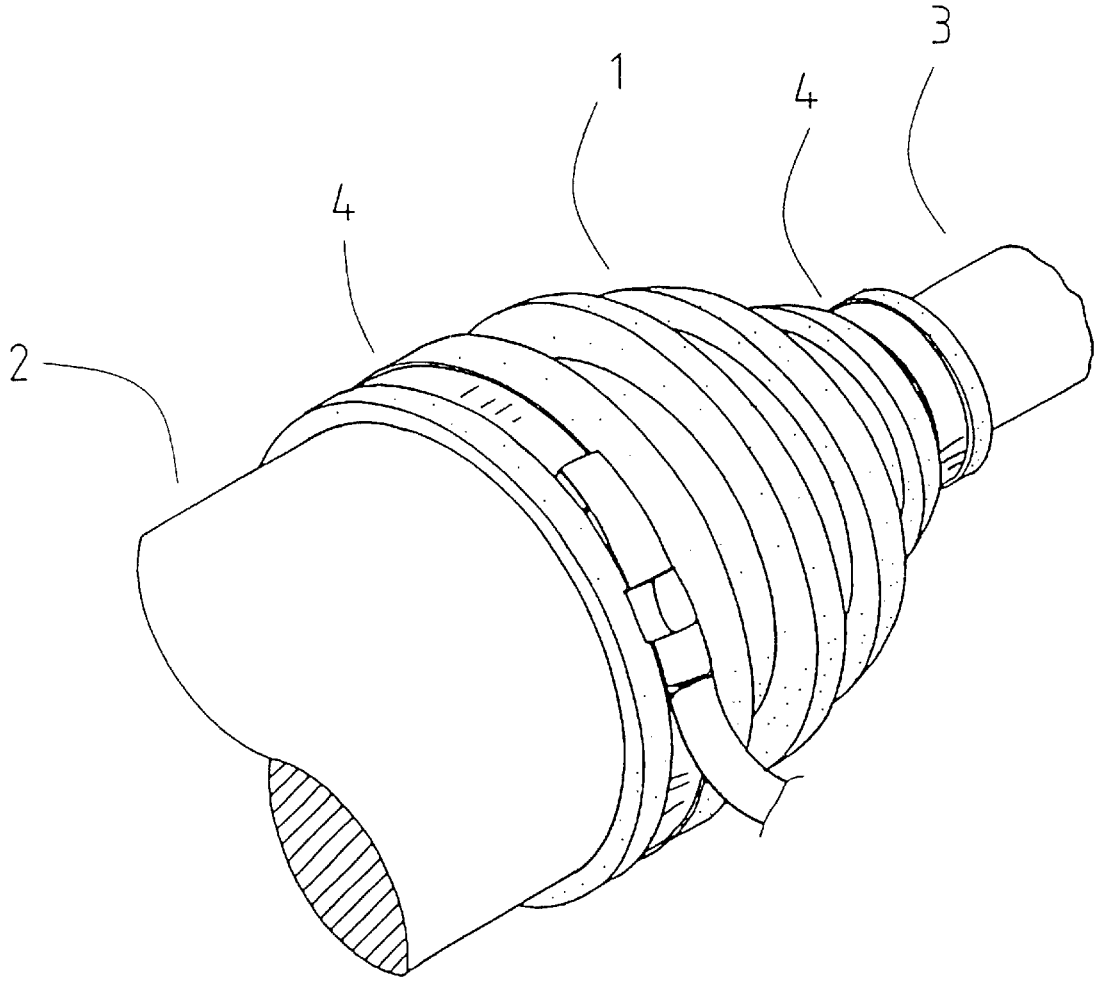
PRIOR ART FIG. 1
FIG. 1 is a perspective view of the dustproof cover and fastening strap of a propeller shaft in accordance with the prior art.
Figure 2:
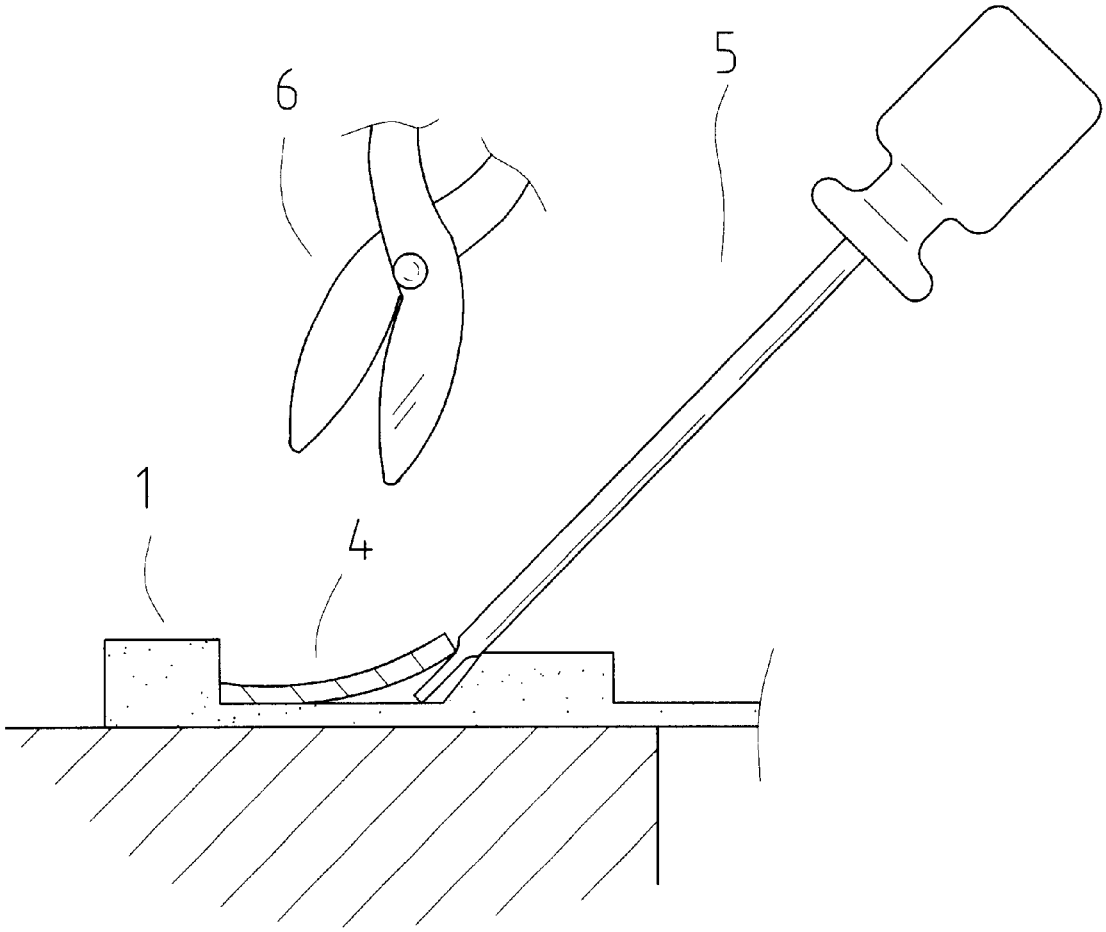
PRIOR ART FIG. 2
FIG. 2 is a cross-sectional view showing a conventional tool for cutting the fastening strap as shown in FIG. 1.
Figure 3:
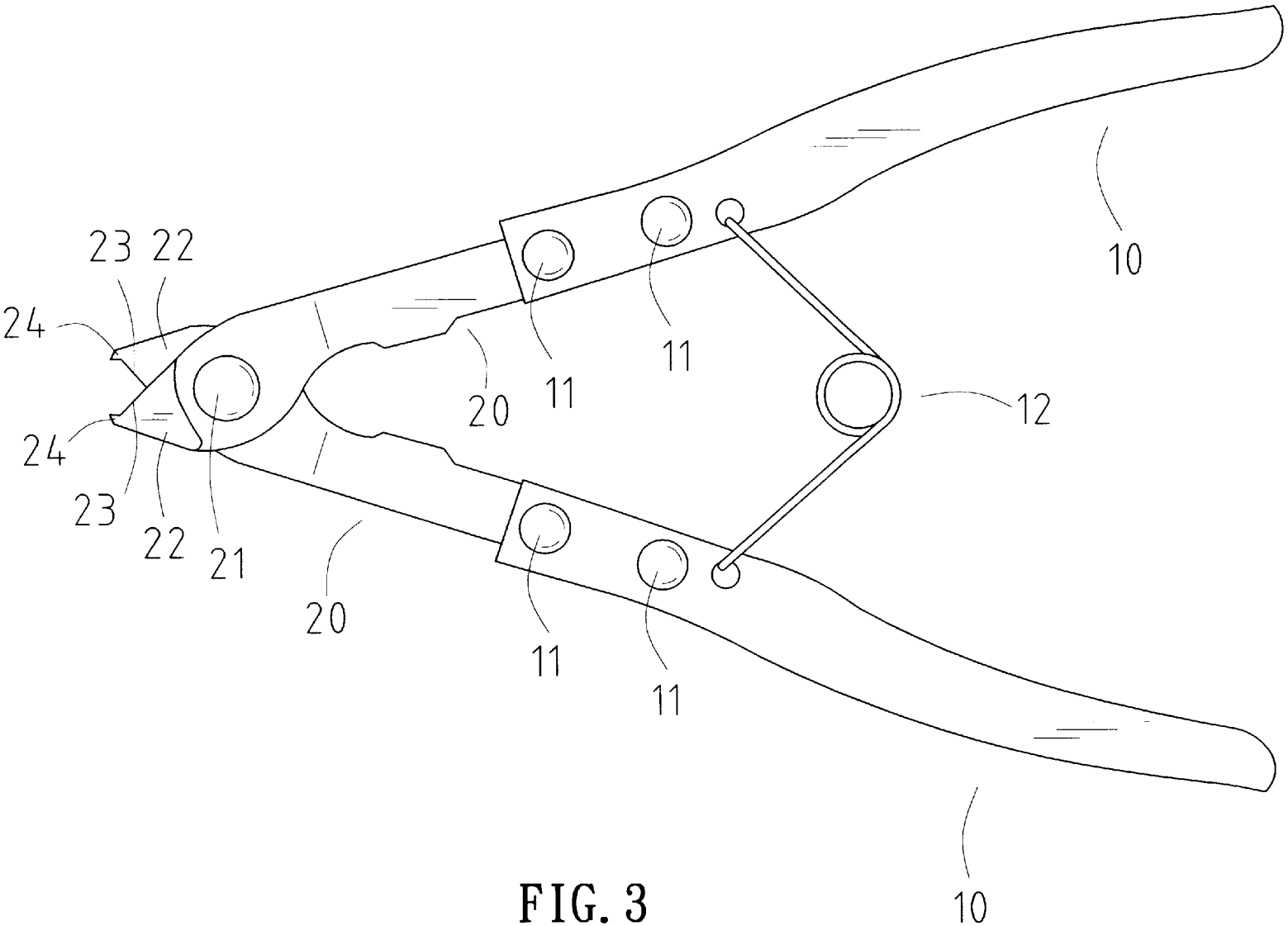
FIG. 3 is a top plan view of a pair of fastening strap scissors in accordance with a first embodiment of the present invention.
Figure 4:
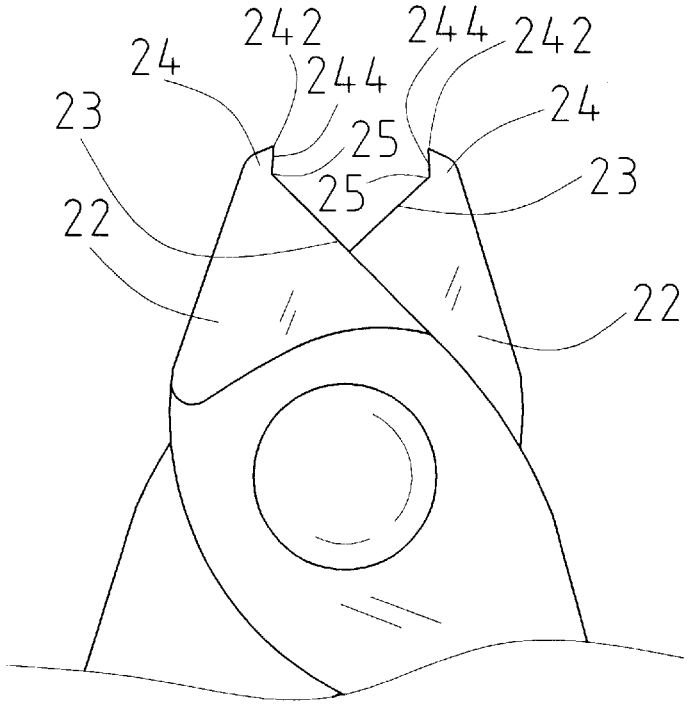
FIG. 4 is a locally enlarged view of the pair of fastening strap scissors as shown in FIG. 3.
Figure 5:
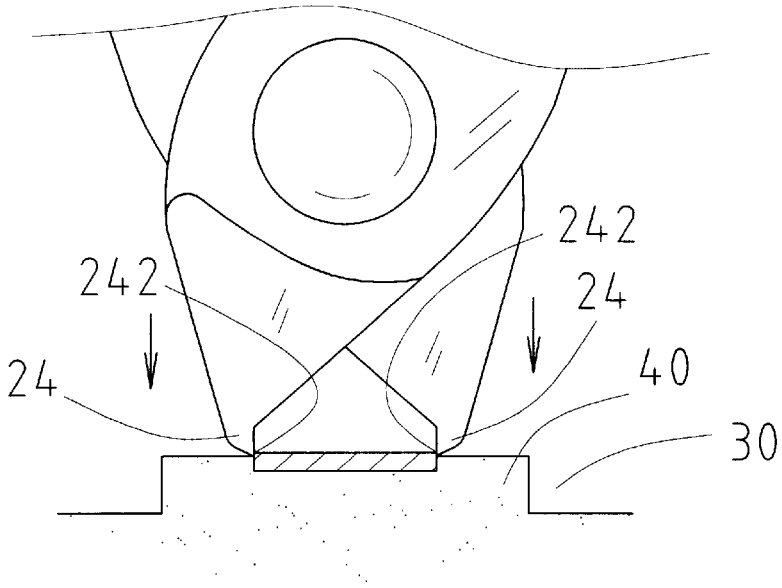
FIG. 5 is a schematic operational view of the pair of fastening strap scissors as shown in FIG. 4 in use.

Referring to the drawings and initially to FIGS. 3–5, a pair of fastening strap scissors in accordance with a first embodiment of the present invention comprises two handles 10, and two blades 20.

The two blades 20 are pivoted with each other by a pivot axle 21. Each of the two blades 20 has a first end formed with a cutting section 22, and a second end secured with a respective handle 10 by rivets 11.

The cutting section 22 of each of the two blades 20 is formed with an oblique blade edge 23 opposite to each other. The distance between the blade edge 23 and the pivot axle 21 is much shorter than that between the pivot axle 21 and the distal end of the handle 10, so that the two handles 10 can be moved toward each other to drive the two blade edges 23 to cut the fastening strap 40 in an energy saving manner.

The cutting section 22 of each of the two blades 20 has a distal end formed with a bent hook 24. The bent hook 24 has a distal end formed with a hook tip 242 located outside of the blade edge 23. An oblique guide face 244 is formed on the bent hook 24 and located between the blade edge 23 of the cutting section 22 and the hook tip 242 of the bent hook 24 of the cutting section 22. An insertion angle 25 is formed on the connection of the guide face 244 and the blade edge 23.

By such an arrangement, the two opposite bent hooks 24 may clip and hook the two side edges of the fastening strap 40, thereby retaining the fastening strap 40 between the blade edges 23. The guide face 244 can be used to guide the side edge of the fastening strap 40 to slide and insert into the insertion angle 25, so as to clip the fastening strap 40, thereby facilitating the work of cutting the fastening strap 40.

In addition, the fastening strap scissors also comprises a push spring 12 mounted between the two handles 10 and having two ends each pivoted with a respective handle 10, such that the opposite blade edges 23 of the blades 20 are maintained at a normally open state, thereby enhancing a convenience of usage.

Figure 6:
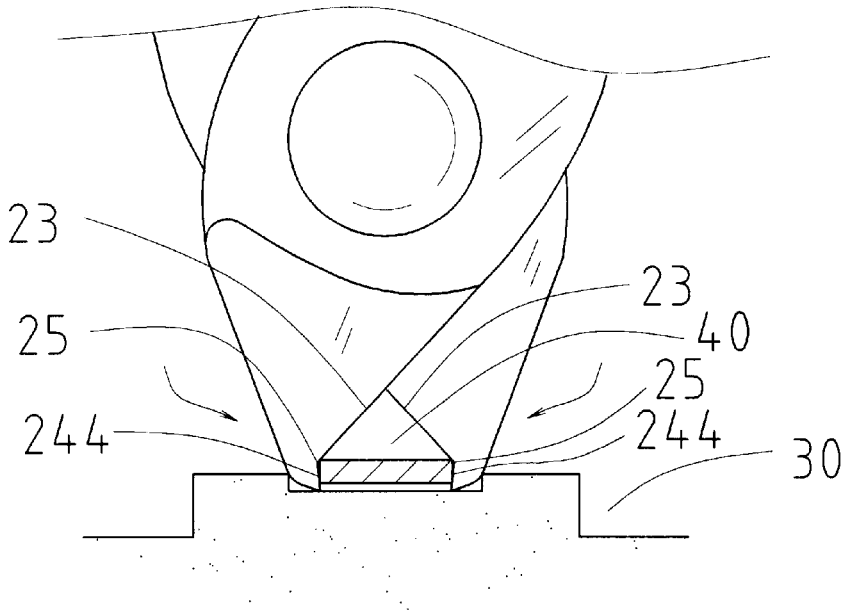
FIG. 6 is a schematic operational view of the pair of fastening strap scissors as shown in FIG. 5.
Figure 7:
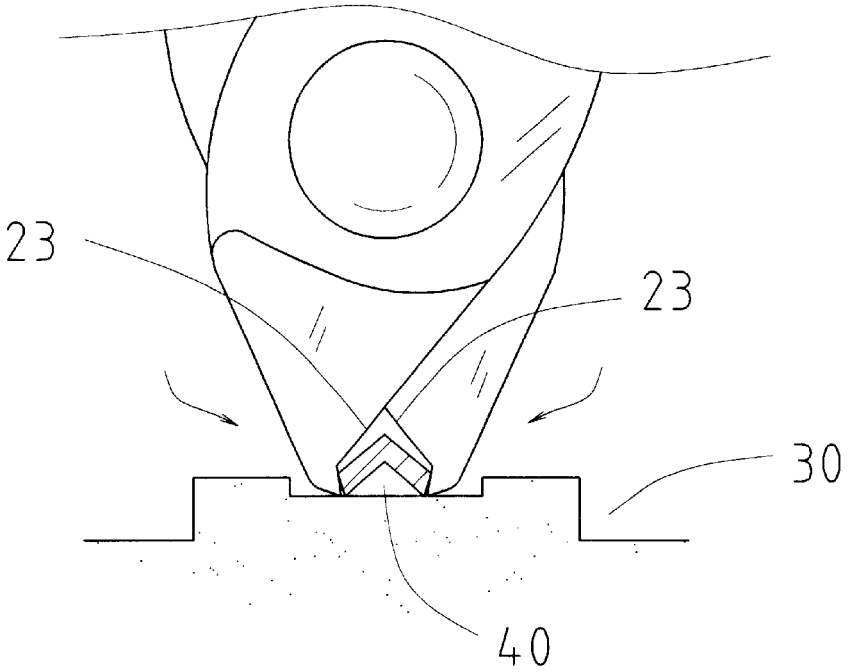
FIG. 7 is a schematic operational view of the pair of fastening strap scissors as shown in FIG. 6.

In operation, referring to FIGS. 5–7 with reference with FIGS. 3 and 4, the fastening strap scissors in accordance with the present invention can be used to cut the fastening strap 40 that encompasses the outer periphery of the dustproof cover 30 of an automobile.

The outer edge of each bent hook 24 is pressed on the dustproof cover 30 at each of the two sides of the fastening strap 40 as shown in FIG. 5, so that the dustproof cover 30 is compressed, thereby facilitating the hook tip 242 of the bent hook 24 being inserted into the bottom edge of the fastening strap 40.

Then, the two handles 10 are pressed to move toward each other, so that the two bent hooks 24 are rotated to displace relative to each other. At the same time, the two side edges of the fastening strap 40 are guided by the guide face 244 to be inserted into the insertion angle 25 as shown in FIG. 6.

Then, the two handles 10 ate continuously pressed to move toward each other, so that the two blade edges 23 are rotated to displace relative to each other, thereby clipping and squeezing the fastening strap 40, so as to bent the fastening strap 40 as shown in FIG. 7, thereby cutting the fastening strap 40.

In such a manner, the operator can easily cut the fastening strap 40 without assistance of a screwdriver having a flat tip, thereby increasing the convenience of use. In addition, after the fastening strap 40 is clipped and squeezed, the fastening strap 40 is substantially perpendicular to the respective blade edge 23 as shown in FIG. 7, so that the fastening strap 40 can be cut out easily. Further, the obtuse shaped outer edge of the bent hook 24 is in contact with the dustproof cover 30, so that the bent hook 24 will not penetrate the dustproof cover 30 during the cutting process. Further, when the operation space is narrow, the cutting section 22 is directly extended into the narrow space to cut the fastening strap 40 without having to extend the operator's hand to the adjoining position of the dustproof cover 30, thereby facilitating the cutting operation.

Figure 8:
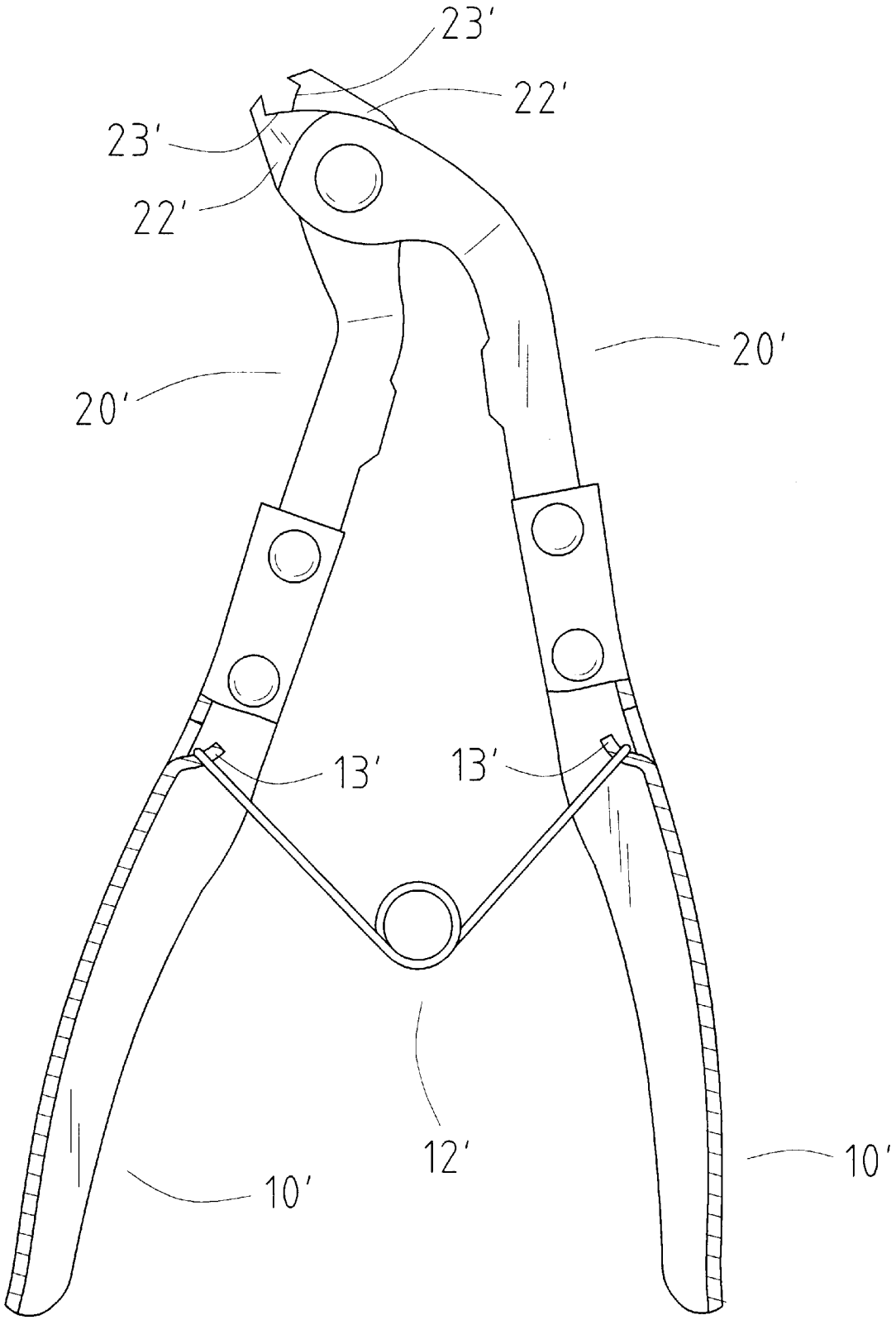
FIG. 8 is a top plan view of a pair of fastening strap scissors in accordance with a second embodiment of the present invention.

Referring to FIG. 8, a pair of fastening strap scissors in accordance with a second embodiment of the present invention comprises two handles 10', and two blades 20'. The two blades 20' are pivoted with each other. Each of the two blades 20' has a first end formed with a cutting section 22', and a second end secured with a respective handle 10'. The cutting section 22' of each of the blades 20' is bent and extended in the same direction to form a side bent shape. In such a manner, if the fastening strap to be cut is placed in a narrow space, such as in the engine chamber, the cutting section 22' can be extended into the space conveniently to cut the fastening strap, thereby greatly enhancing the convenience of operation. In addition, each of the handles 10' has an outer wall extended inward and formed with a hanging hook 13', and each of the two ends of the push spring 12' is hooked on the hanging hook 13' of a respective handle 10', thereby positioning the push spring 12', so that the opposite blade edges 23' are maintained at a normally opened state, thereby enhancing the convenience of operation.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pair of fastening strap scissors comprising:

two blades (20) pivoted with each other, and each having a first end and a second end, said first end of each of said two blades (20) formed with a cutting section (22), said cutting section (22) of each of said two blades (20) formed with an oblique blade edge (23) opposite to each other; and two handles (10) each having one end secured to said second end of a respective blade (20);

wherein, said cutting section (22) of each of said two blades (20) has a distal end formed with a bent hook (24), said bent hook (24) has a distal end formed with a hook tip (242) located outside of said blade edge (23), an oblique guide face (244) is formed on said bent hook (24) and located between said blade edge (23) of said cutting section (22) and said hook tip (242) of said bent hook (24) of said cutting section (22), and an insertion angle (25) is formed on a connection of said guide face (244) and said blade edge (23) to clip a fastening strap, thereby facilitating a work of cutting said fastening strap.

2. The fastening strap scissors in accordance with claim 1, further comprising a push spring (12) mounted between said two handles (10) and having two ends each pivoted with a respective handle (10), such that said opposite blade edges (23) of said blades (20) are maintained at a normally open state, thereby enhancing a convenience of usage.

3. The fastening strap scissors in accordance with claim 2, wherein each of said handles (10') has an outer wall extended inward and formed with a hanging hook (13'), and each of said two ends of said push spring (12') is hooked on said hanging hook (13') of a respective handle (10'), thereby positioning said push spring (12').

4. The fastening strap scissors in accordance with claim 1, wherein said cutting section (22') of each of said blades (20') is bent and extended in the same direction to form a side bent shape, thereby enhancing a convenience of operation.

* * * * *